United States Patent [19]

Raught

[11] Patent Number: 4,665,575

[45] Date of Patent: May 19, 1987

[54] VENTILATING MATTRESS MODULE SYSTEMS FOR BOATS, RECREATIONAL VEHICLES, AND THE LIKE

[75] Inventor: Dean A. Raught, 1041 Manning St., Seattle, Wash. 98134

[73] Assignee: Dean A. Raught, Seattle, Wash.

[21] Appl. No.: 742,398

[22] Filed: Jun. 7, 1985

[51] Int. Cl.[4] ..... A47C 27/05

[52] U.S. Cl. ..... 5/468; 5/465; 5/448; D6/596; 441/128

[58] Field of Search ..... 5/465, 468, 469, 423, 5/448, 481, 475, 420; 296/174, 69; 114/188, 192; 441/127, 129, 128; D6/605, 596

[56] References Cited

U.S. PATENT DOCUMENTS

| | | | |
|---|---|---|---|
| 813,731 | 2/1906 | Murmans . | |
| 869,766 | 10/1907 | Antoni . | |
| 2,296,559 | 9/1942 | Krakauer | 5/468 |
| 2,493,067 | 1/1950 | Goldsmith . | |
| 2,978,972 | 4/1961 | Hake . | |
| 3,090,972 | 5/1963 | Pelletier | 5/468 |
| 3,266,064 | 8/1966 | Figman | 5/469 |
| 4,004,305 | 1/1977 | Rubin | 5/465 |
| 4,292,703 | 10/1981 | Goguen | 5/468 |
| 4,445,241 | 5/1984 | Ender et al. | 5/468 |

FOREIGN PATENT DOCUMENTS

| | | | |
|---|---|---|---|
| 110178 | 4/1940 | Australia | 5/468 |
| 506926 | 4/1954 | Canada | 5/468 |
| 1321865 | 7/1973 | United Kingdom | 5/468 |

*Primary Examiner*—Alexander Grosz

*Attorney, Agent, or Firm*—Garrison & Stratton

[57] ABSTRACT

A mattress composed of various innerspring type mattress modules for use in boats, motorhomes, and recreational vehicles. Each module has large-screened side openings to match the side openings of adjacent modules to facilitate the exchange of air into the module or to facilitate air flow through a module to an isolated one.

6 Claims, 6 Drawing Figures

VENTILATING MATTRESS MODULE SYSTEMS FOR BOATS, RECREATIONAL VEHICLES, AND THE LIKE

BACKGROUND OF THE INVENTION

This present invention relates to mattresses to be used on boats, motorhomes, recreational vehicles and the like, particularly mattresses which are composed of an array of mattress modules.

Despite their expense or heavy energy comsumption, the popularity of boats, either power or sails, motorhomes, and recreational vehicles has continued to be a popular form of vacationing.

Larger boats, motorhomes and recreational vehicles are designed to be homes away from home. They usually have most, if not all of the modern conveniences: living space, fully equipped cooking area, a bathroom or "head", and sleeping areas. Because of space constraints many of the spaces within these vehicles serve more than one purpose. The major criteria used for determining sleeping areas in these "homes away from home" is space. Each type of boat, motorhome, or recreational vehicle will have its own particular seating and sleeping arrangements designed according to the particular shape and size of the area. For instance, a sleeping area used during the day for eating or socializing may also serve as a resting surface for sleeping. The mattress modules or cushions to be used for these purposes are usually custon made to fit the areas available within the vehicle for these purposes.

The qualities of a good mattress are that it be resiliently strong, soft, insulating, and have a moisture absorbing or porous surface. A problem in prior art mattress structures has been condensation of the moisture in areas of the mattress which are inadequately ventilated.

It is the standard practice in the art of mattress making to construct a sleeping surface such as a mattress by assembling a network of large helical-shaped innersprings tied together with wire joinders in a gridlike fashion to form a sturdy but resilient weight supporting inner structure. Usually a foam rubber or foam polyurethane pad is layered upon the ends of the springs and the mattress is then covered using a thick, strong, and porous covering material such as cotton. Often instead of the foam rubber or foam polyurethane, a Kapok material, is used to form the layer above the springs. The unit is sewn closed. Sometimes small holes are spaced around the sides of the mattress. Pull strings sewn through the mattress in a gridlike fashion are anchored to buttons on the top and bottom surfaces at the anchor buttons.

Using these techniques strong, nearly hollow, and light-weight, comfortable mattresses are constructed. It has been the practice to use these mattresses on boats, motorhomes, and recreational vehicles. However, a major problem using these mattresses on these types of vehicles is that the mattress may lie upon a cold surface. Because the mattress is porous, a warm person sleeping upon the mattress will drive warm, moist air down throught the mattress. This warm, moist air will eventually reach the cold under surface where some of the moisture will condense. Over a period of time, this moisture will accumulate to the point where the rapid decomposition of the bottom of the mattress will occur. This problem significantly lowers the useful life of mattresses used in boats, motorhomes recreational vehicles and the like. In addition, a moist, dark area without air circulation encourages the growth of mold and mildew, rendering the mattress and pads of the prior art unpleasant to use.

It is known that if airflow can be induced through the sides of the mattress into the mattress, the problem of bottom condensation and mold growth can be reduced or eliminated.

Mattresses with openings to let air enter the interior are not new. Nevertheless, the openings on these mattresses are typically small, and are occluded if positioned adjacent to other objects or other mattresses. By abutting mattresses with other mattresses the air exchange within the mattress will be significantly decreased or stopped altogether.

Therefore, it is an object of my invention to provide mattress modules with large side opening means such that air will flow freely in and out of the interior of the mattress module, and if positioned adjacent to a similar module, from one mattress module to another.

It is a further object of my invention to facilitate the flow of air from the environment to the interior of a mattress module which is adjacent to one or more similar mattress modules.

It is another object of my invention to provide large mesh covered openings along certain sides of mattress modules to facilitate the air exchange from the environment through one cushion into another cushion adjacent thereto or to the open atmosphere.

These and other objects and advantages of invention will become readily apparent to one of skill in this art upon a detailed examination of the appended drawings and study of the description thereof which follows.

SUMMARY OF THE INVENTION

My mattress is composed of various mattress modules, each having an innerspring system and mattress-like upper surface with pliable fabric and porous covering. Some of the sides of the modules have large openings which are screened with a course-weave cloth such as cheese cloth or nylon netting. The large openings on the sides are located to match corresponding openings on the sides of adjacent modules such that as the modules are placed together air easily interchanges between the modules and the environment.

Thus instead of the moist air from the body being driven through the mattress to condense on bottom cold surfaces, the air exchanges and mixes with air coming from other mattresses and the environment. Because of the arrangement of the large side openings, the interior of the mattresses and their bottoms remain dry thereby discouraging the growth of mold and mildew.

DETAILED DESCRIPTION OF THE PREFERRED EMBODIMENT

Because each mattress module system is designed according to the configuration and space available, the particular configurations described herein are demonstrative of how large openings on the sides of mattress modules, corresponding to similar openings on abutting mattress modules, facilitate the flow of air into a module or through an adjoining module into an isolated one.

Figure 1:
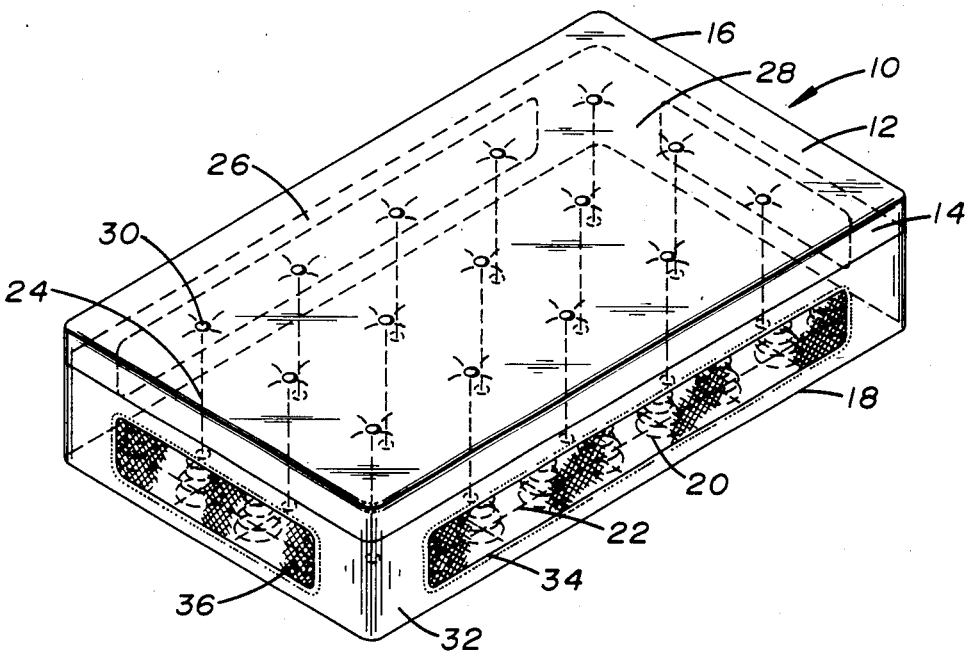
FIG. 1 is a perspective view of a mattress module with my invention therein.
Figure 2:
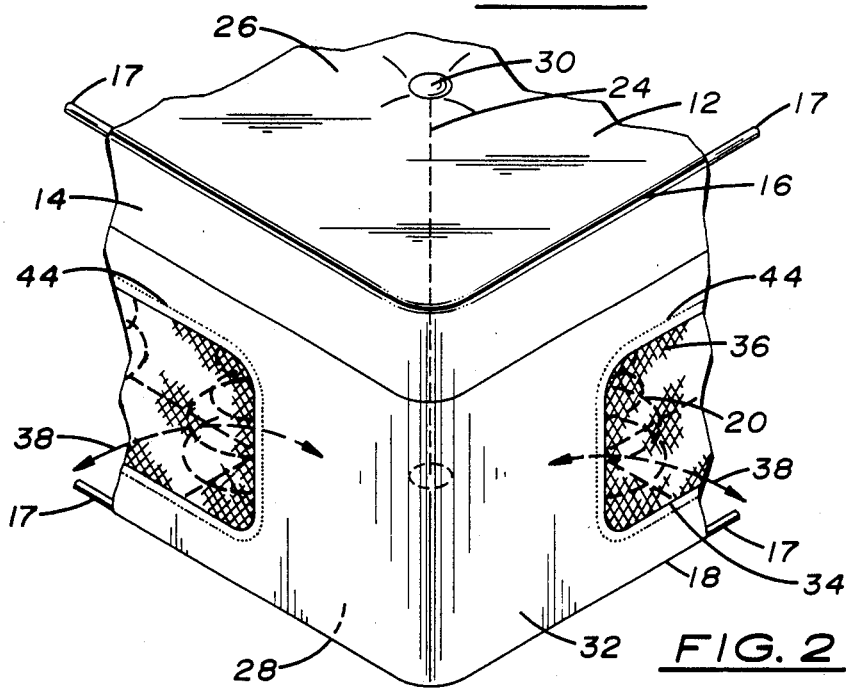
FIG. 2 is an enlarged perspective view of an outside corner of the mattress module shown in FIG. 1.
Figure 3:
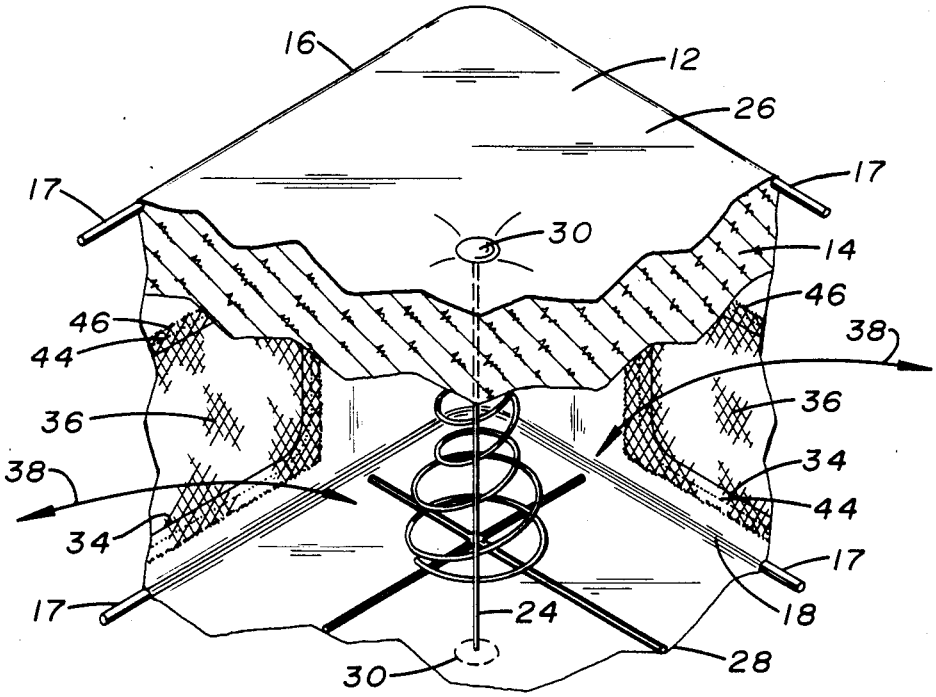
FIG. 3 is an enlarged perspective view from the inside corner of the mattress module shown in FIG. 1.
Figure 4:
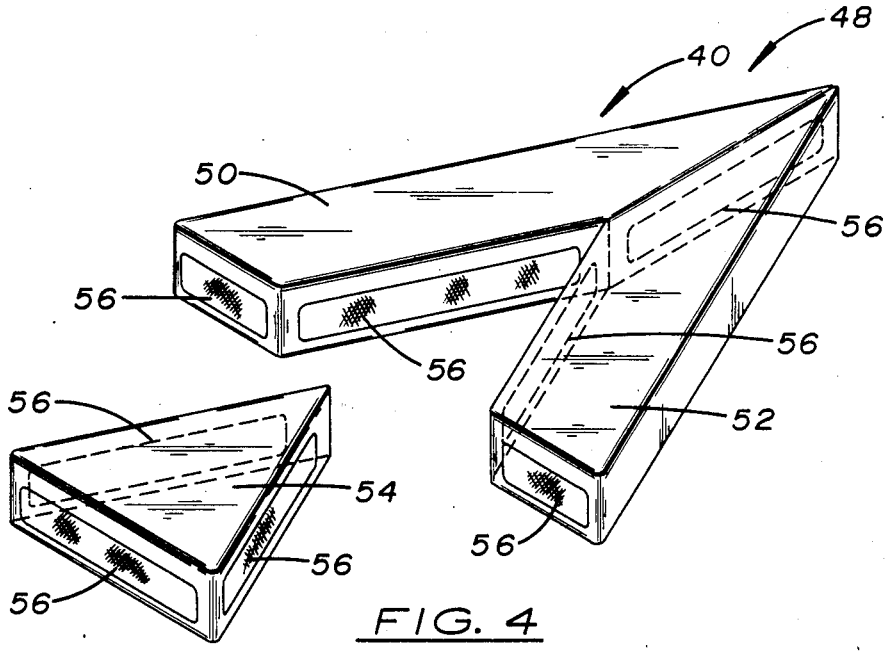
FIG. 4 is a perspective view of an arrangement of mattress modules incorporating my invention placed adjacent to each other.

FIG. 1 shows a perspective view of an idealized mattress module 10 indicating a porous fabric covering 12, covering a foam rubber top pad 14. For comfort, this foam rubber top pad should be at least two centimeters thick, preferably five. The module 10 is generally covered in its entirety by the pliable fabric covering 12. Cotton is generally used as the pliable covering for this purpose since it is soft, strong, porous, and insulating. The fabric covering 10 is generally stitched at the seam lines along the top edges 16 and bottom edges 18. The top 16 and bottom 18 edges of the mattress module can be squared by the use of a welt or wire-like stiffener 17 sewn within the seams 16 and 18.

A network of helical-shaped inner springs 20 interconnected to each other by wire joiners 22 and arranged in a gridlike fashion throughout the interior of each mattress module 10 provides a resilient, weight supporting means. Pull strings 24 are used to join the top surface 26 to the botton surface 28 through the module 10 in a gridlike fashion. The pull strings 24 flatten the top 26 and bottom 28 surfaces of the mattress module 10 into a parallel configuraton and terminate on the surface at buttons 30. Large sections of the sides 32 of the mattress module have openings 34 which are covered using air permeable netting material 36 such as cheesecloth or nylon netting to facilitate flow of air into and out of the mattress. Any coarse woven fabric having air permeability which can be sewn could be used for these openings 34. The side openings 34 facilitate the movement of air generally indicated by arrows 38 from one module 40 to another module 42 when they are placed adjacent to each other, or directly to the environment.

In designing the specific modules and the side openings 34, the netting material 36 can be cut and stitched along seam lines 44 from the interior of each module. By doing so the edges 46 of the netting 36 are not seen from the outside, enhancing the appearance of the module.

Mattress module system can be described as the collection of variously sized and shaped mattress elements designed to be placed into particular patterns according to their intended uses.

The size and shape of the particular modules will depend upon the size and space available. For example, in the bow bunk of a boat the available space may be a triangular shape 48, which can receive an array of mattress modules arranged as two couches oppositely facing composed of two tetrahedron-shaped mattress modules 50 and 52 which can be converted into a double bed arrangement by the insertion of a triangularly shaped mattress module 54. Each shaped module 50, 52, and 54 have matching large openings 56 to facilitate the free exchange of air, from 54 to 50 and 52 and the environment.

Figure 5A:
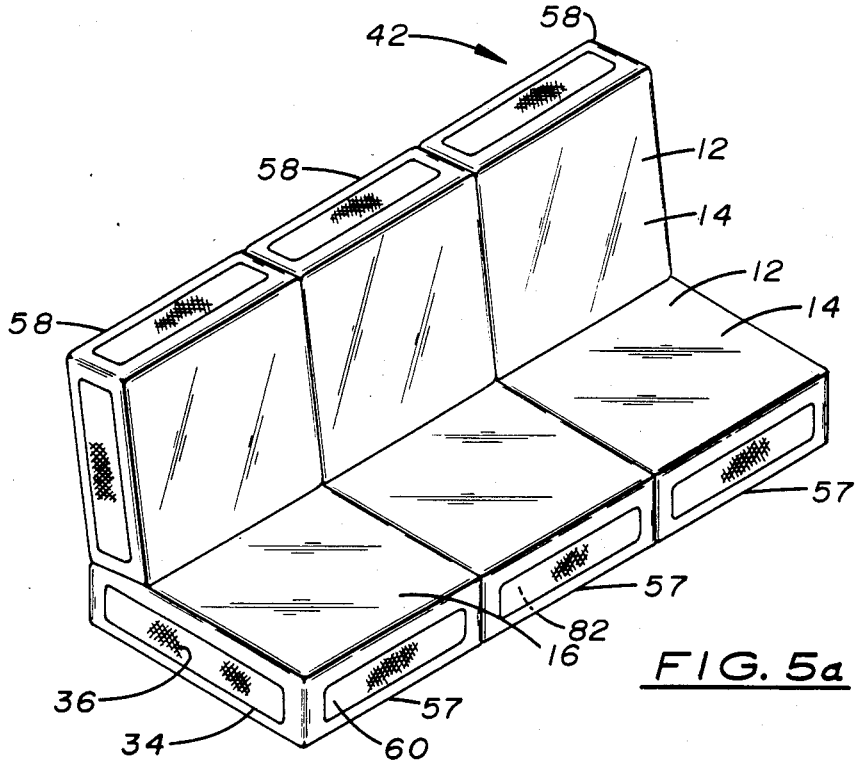
FIG. 5A is a perspective view of mattress module system incorporating my invention in a particular configuration.
Figure 5B:
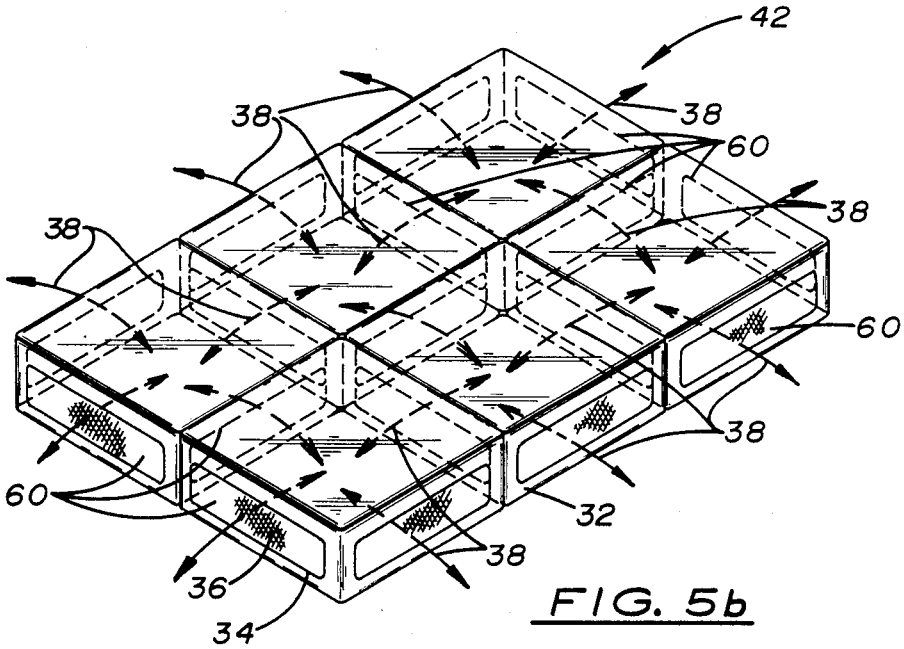
FIG. 5B is a perspective view of the mattress module system as shown in FIG. 5A in another configuration.

Similarly, an array of mattress modules can be aligned in a linear fashion, composed of rectangular mattress modules 57 with similar rectangular mattress modules 58 acting as back pads when the system is used for sitting as in FIG. 5A, or as additional sleeping surfaces when the system is used for sleeping as shown in FIG. 5B. When the back pads 58 are used as sleeping surfaces, air is exchanged into the back pads 58 through the matching side openings 60 of the other mattress modules 57. In the sleeping configuration, air enters the back pieces 58 from the modules 57 and communicates to environmental air as demonstrated by air flow lines 38.

It can also be noted that as a user is either seated or laying upon a mattress module, a certain amount of air pumping action as indicated by arrows 38 is produced by the compression of the top 16 and bottom 18 surfaces, thereby helping the air circulate throughout the modules in an accordion-like fashion.

It is readily apparent from these examples how differently configured multi-shaped mattress modules can be formed with matching adjacent side openings to provide for the exchange of air according to the objectives of my invention, whether or not each module serves a unique purpose or dual purposes. Accordingly, the examples shown herein are only demonstrative and are not to be interpreted as limiting my invention to only these particularly described configurations.

I claim:

1. An array of mattress modules supported on a support means, each module lying adjacent and in contact with at least one other module, each module comprising:

a soft mattress-type upper surface with pliable porous covering;

a bottom surface with pliable covering;

an interior having a spring network weight supporting means;

side elements interconnecting said upper surface and said bottom surface, at least one of said side elements having a large airflow opening in contact with and communicating with a corresponding opening on the side of the adjacent module;

a netting means extending the entirety of said opening.

2. The array of mattress modules as described in claim 1 where said soft mattress-type surface is a foam rubber pad about five centimeters thick.

3. The array of mattress modules described in claim 1 where said netting means is a coarse woven mesh permitting free flow of air into and out of said module.

4. An array of mattress modules supported on a support means each module comprising:

a soft mattress type upper surface with pliable porous covering;

a bottom surface with pliable covering;

an interior having a spring network weight supporting means;

side elements interconnecting said upper surface and said bottom surface, at least one of said side elements having a large airflow opening;

a netting means extending the entirety of said opening, each mattress module being in contact with at least one other mattress module such that at least one of said airflow openings on one module is in contact with and communicates directly with at least one of the airflow openings on another mattress module.

5. The array of mattress modules as described in claim 4 where said soft mattress type upper surface is a foam rubber pad about five centimeters thick.

6. The array of mattress modules described in claim 4 where said netting means is a coarse woven mesh permitting airflow of air into and out of said module.

* * * * *